US008863982B2

(12) United States Patent
Baltz et al.

(10) Patent No.: US 8,863,982 B2
(45) Date of Patent: Oct. 21, 2014

(54) PAIL COVER

(71) Applicant: Rehrig Pacific Company, Los Angeles, CA (US)

(72) Inventors: Kyle L. Baltz, Rossmoor, CA (US); Ryan C. Meers, West Chester, PA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 13/788,745

(22) Filed: Mar. 7, 2013

(65) Prior Publication Data

US 2013/0233873 A1 Sep. 12, 2013

Related U.S. Application Data

(60) Provisional application No. 61/607,670, filed on Mar. 7, 2012.

(51) Int. Cl.
*B65D 51/00* (2006.01)
*B65D 43/02* (2006.01)

(52) U.S. Cl.
CPC ..... *B65D 51/00* (2013.01); *B65D 2543/00194* (2013.01); *B65D 2543/00805* (2013.01); *B65D 2543/00203* (2013.01); *B65D 2543/00555* (2013.01); *B65D 2543/00537* (2013.01); *B65D 2543/0099* (2013.01); *B65D 2543/00685* (2013.01); *B65D 43/0262* (2013.01); *B65D 2543/00648* (2013.01); *B65D 2543/00509* (2013.01); *B65D 2543/00296* (2013.01); *B65D 2543/00092* (2013.01); *B65D 2543/0074* (2013.01)
USPC ..... 220/780; 220/276

(58) Field of Classification Search
USPC ..... 220/790, 200, 378, 780, 792, 784, 789, 220/794, 795, 276; 215/344, 256, 254
See application file for complete search history.

(56) References Cited

U.S. PATENT DOCUMENTS

| | | | | | |
|---|---|---|---|---|---|
| 4,177,930 | A * | 12/1979 | Crisci | ..... | 220/284 |
| 4,506,784 | A | 3/1985 | Kanfer | | |
| 4,711,364 | A * | 12/1987 | Letica | ..... | 220/276 |
| 4,930,656 | A | 6/1990 | Blanchette | | |
| 5,294,015 | A * | 3/1994 | Landis | ..... | 220/784 |
| 5,540,349 | A * | 7/1996 | Philips | ..... | 220/780 |
| 6,543,635 | B2 | 4/2003 | Ciccone | | |
| 6,779,676 | B2 * | 8/2004 | Ciccone | ..... | 220/276 |
| 7,207,457 | B2 | 4/2007 | Schwarz | | |
| 7,922,028 | B2 | 4/2011 | Baltz | | |
| 2003/0160051 | A1 | 8/2003 | Ciccone | | |

* cited by examiner

*Primary Examiner* — Andrew Perreault
(74) *Attorney, Agent, or Firm* — Carlson, Gaskey & Olds

(57) ABSTRACT

A container lid includes a panel portion and an outer wall portion having a ledge protruding inwardly therefrom. A plurality of tabs extend downward from the outer wall portion. At least two of the plurality of tabs are separated from one another by a gap. The ledge of the outer wall portion extends across the gap to provide a seal across the gap. A tear strip removably connects the plurality of tabs to one another.

21 Claims, 8 Drawing Sheets

PAIL COVER

BACKGROUND

The present invention relates generally containers with removable covers or lids, such as pails.

Some lids for containers, such as pails, include an upper panel portion and an outer wall portion that fits over the upper edge of the container wall. The outer wall portion includes a ledge that snaps over a lip protruding outward from the upper edge of the container wall. Tabs project through the ledge and to a lowermost edge of the outer wall. The tabs are separated from one another by gaps and are secured to one another by a tear strip. The tear strip prevents the tabs from being deflected outward, which would permit the ledge to deflect outward to release the lid from the container. After the tear strip is removed, the tabs and ledge can be deflected outward to release the lid from the container.

SUMMARY

A container lid includes a panel portion and an outer wall portion having a ledge protruding inwardly therefrom. A plurality of tabs extend downward from the outer wall portion. At least two of the plurality of tabs are separated from one another by a gap. The ledge of the outer wall portion extends across the gap to provide a seal across the gap. A tear strip removably connects the plurality of tabs to one another.

By extending the ledge across the gaps between the tabs, the lid provides a better seal to the container. If necessary, optional stress risers can be added to the gaps so that, after the tear strip is removed, the ledge can stretch and/or tear at the gaps to permit removal of the lid. Optionally, the portion of the ledge across the gap (a bridge portion) can be made smaller than the rest of the ledge. In other words, the bridge portion may protrude inward from the outer wall portion less than the rest of the ledge. This provides a seal, but more easily permits removal of the lid after the tear strip is removed.

DESCRIPTION OF A PREFERRED EMBODIMENT

Figure 1:
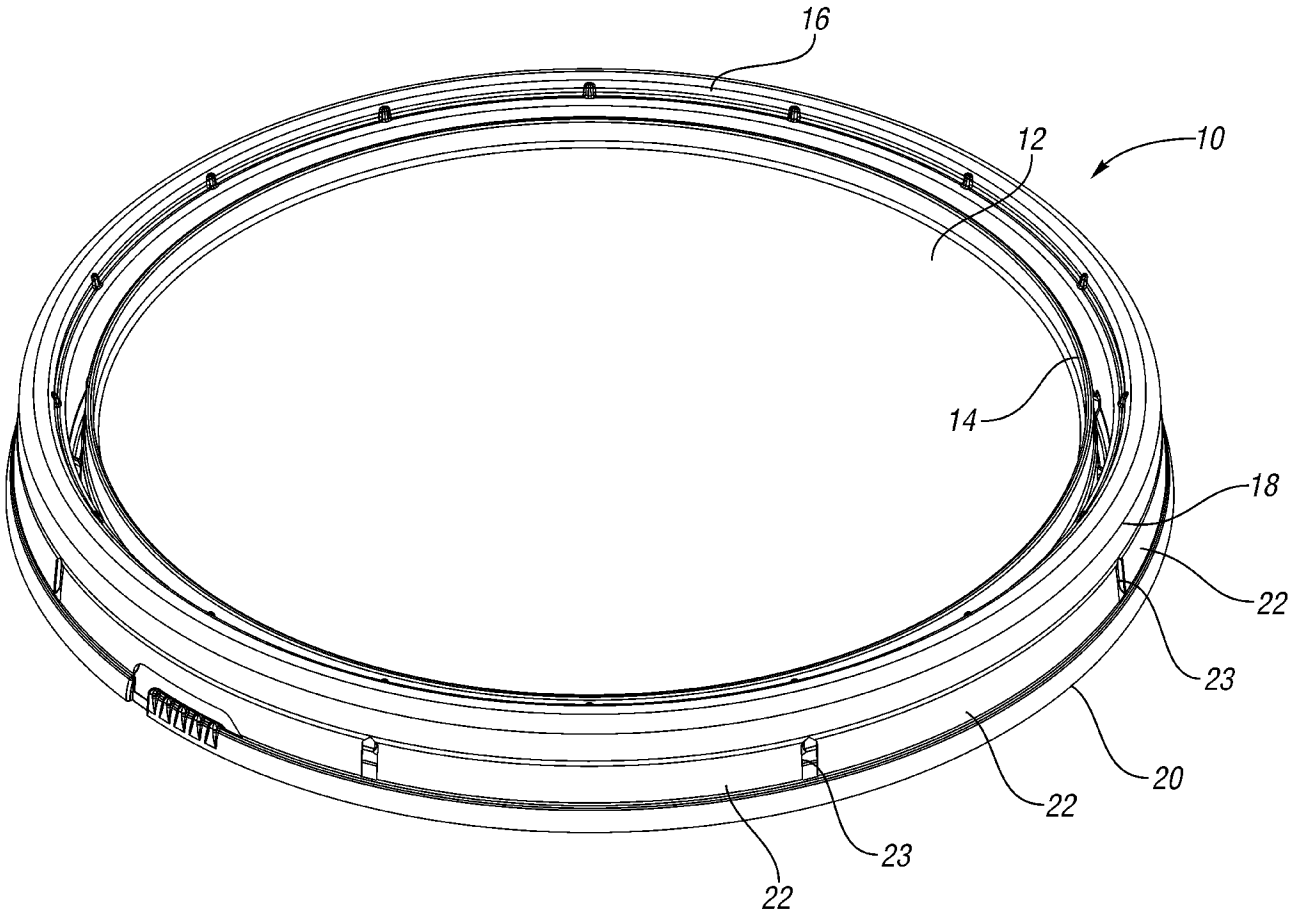
FIG. 1 is an upper perspective view of a lid according to one embodiment of the present invention.

Referring to FIG. 1, a pail lid 10 includes a generally circular panel portion 12 circumscribed by a generally vertical, annular, inner wall portion 14. The inner wall portion 14 is spaced inward from and circumscribed by a generally vertical, annular, mid-wall portion 16, which in turn is spaced inward from and circumscribed by a generally vertical, annular outer wall portion 18. The lid 10 includes at least one tear strip 20 at a lower end of the outer wall portion 18. The tear strip 20 is removably connected to the lower ends of a plurality of tabs 22 extending downward from the outer wall portion 18 and separated by gaps 23. As is known, when the tear strip 20 is removed from the lower ends of the tabs 22, the lower ends of the tabs 22 are able to flex radially outward, thereby permitting removal of the lid 10.

Figure 2:
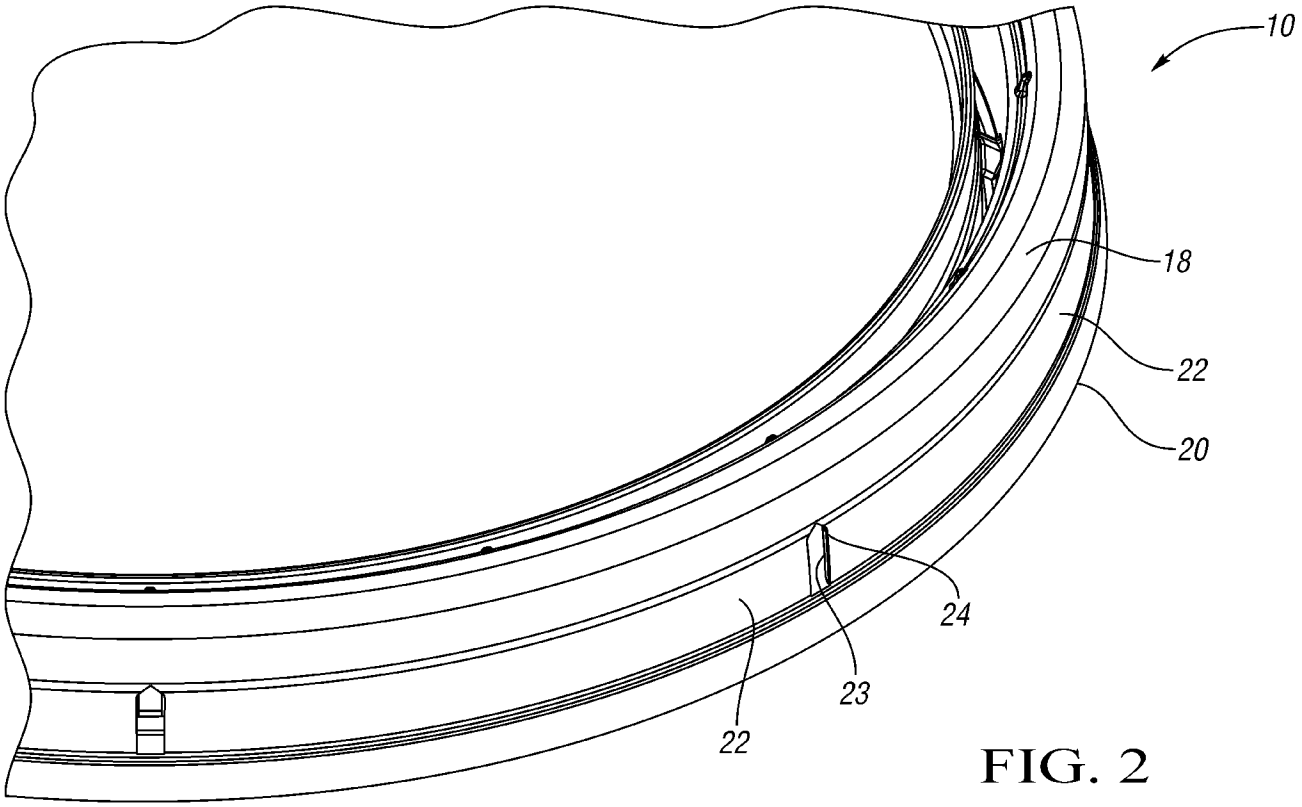
FIG. 2 is an enlarged view of a portion of the lid of FIG. 1.

FIG. 2 is an enlarged view of a portion of the lid 10. As shown, each gap 23 may include an optional stress riser 24, such as a narrowed, pointed portion (as shown) and/or thinner portion. The stress riser 24 in the wall facilitates tearing and/or stretching, which assists in permitting the tabs 22 to flex and separate from one another after the tear strip 20 is removed.

Figure 3:
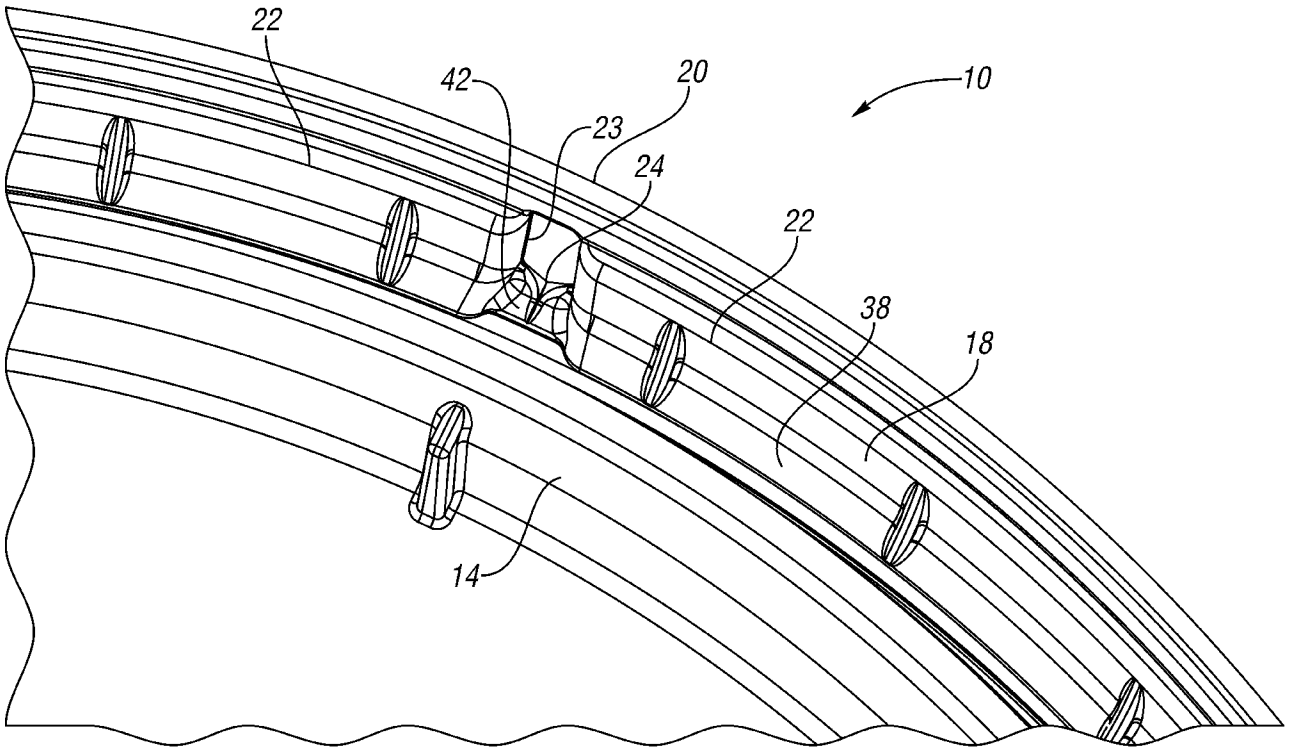
FIG. 3 is a bottom perspective view of the enlarged portion of the lid of FIG. 2.

FIG. 3 is a bottom perspective view of the enlarged portion of the lid 10 of FIG. 2. As shown, the tear strip 20 extends across the gap 23, connecting adjacent tabs 22. The outer wall portion 18 includes an annular upper ledge 38 protruding inwardly therefrom. The upper ledge 38 includes a bridge portion 42 extending across each gap 23.

Figure 4:
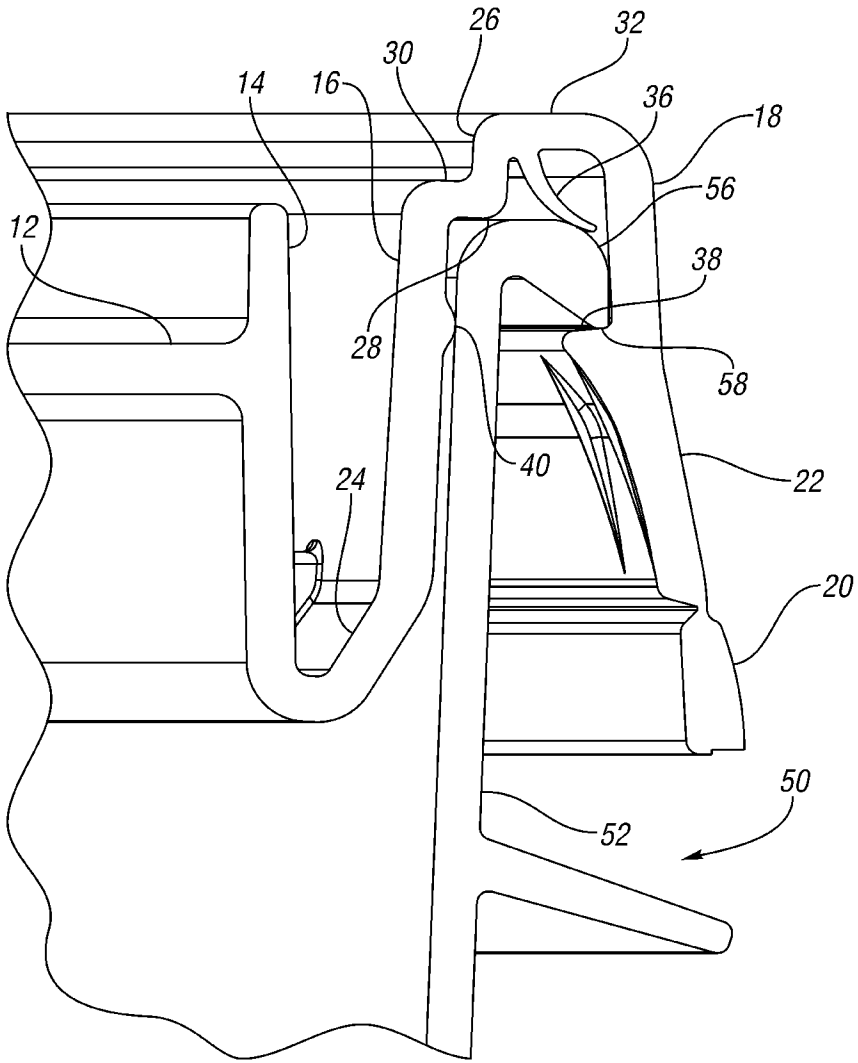
FIG. 4 is a section view through an outer portion of the lid.

FIG. 4 is a section view through an outer portion of the lid 10. As shown, the inner wall portion 14 may, but need not, protrude upward higher than the panel portion 12. A lower end of the inner wall portion 14 is connect to a lower end of the mid-wall portion 16 by an angled wall portion 25 that angles upward from the lower end of the inner wall portion 14 to the lower end of the mid-wall portion 16.

An offset portion 26 extends upward from an upper end of the mid-wall portion 16 and is offset outwardly relative to the mid-wall portion 16, thereby defining a shoulder 28 having a downward-facing contact surface and an upper recess 30. An annular upper wall portion 32 connects an upper end of the offset portion 26 to an upper end of the outer wall portion 18. A seal 36 molded integrally with the lid 10 extends downward and outward from the upper wall portion 32 toward the outer wall portion 18. The seal 36 extends downward below the shoulder 28. Alternatively, there could be a gasket between the outer wall portion 18 and the offset portion 26 (or the mid-wall portion 16).

An interior surface of the outer wall portion 18 includes the upper ledge 38 spaced below the seal 36. An integral bead or cork seal 40 is formed on an exterior surface of the mid-wall portion 16 roughly opposite the upper ledge 38.

FIG. 4 shows the section of the lid 10 secured to an upper end of a pail 50, with the section taken through one of the tabs 22. The pail 50 includes a pail wall 52 having an outwardly protruding lip 58. When the lid 10 is snapped onto the pail 50, the lip 58 of the pail 50 snaps past the ledge 38 on the outer wall portion 18. The cork seal 40 contacts the pail wall 52. The lip 58 (and/or the upper end of the pail wall 52) contacts the seal 36 and deflects the seal 36, forming a seal between the lid 10 and the pail 50. Alternatively, a gasket in the lid 10 could form the seal. To prevent damage to the seal 36, such as by over-deflection when the lid 10 is snapped onto the pail 50 with excessive force, the lip 58 and/or upper end of the pail wall 52 will contact the shoulder 28 on the lid 10, preventing the lip 58 from deflecting the seal 36 upward further than the shoulder 28.

Figure 5:
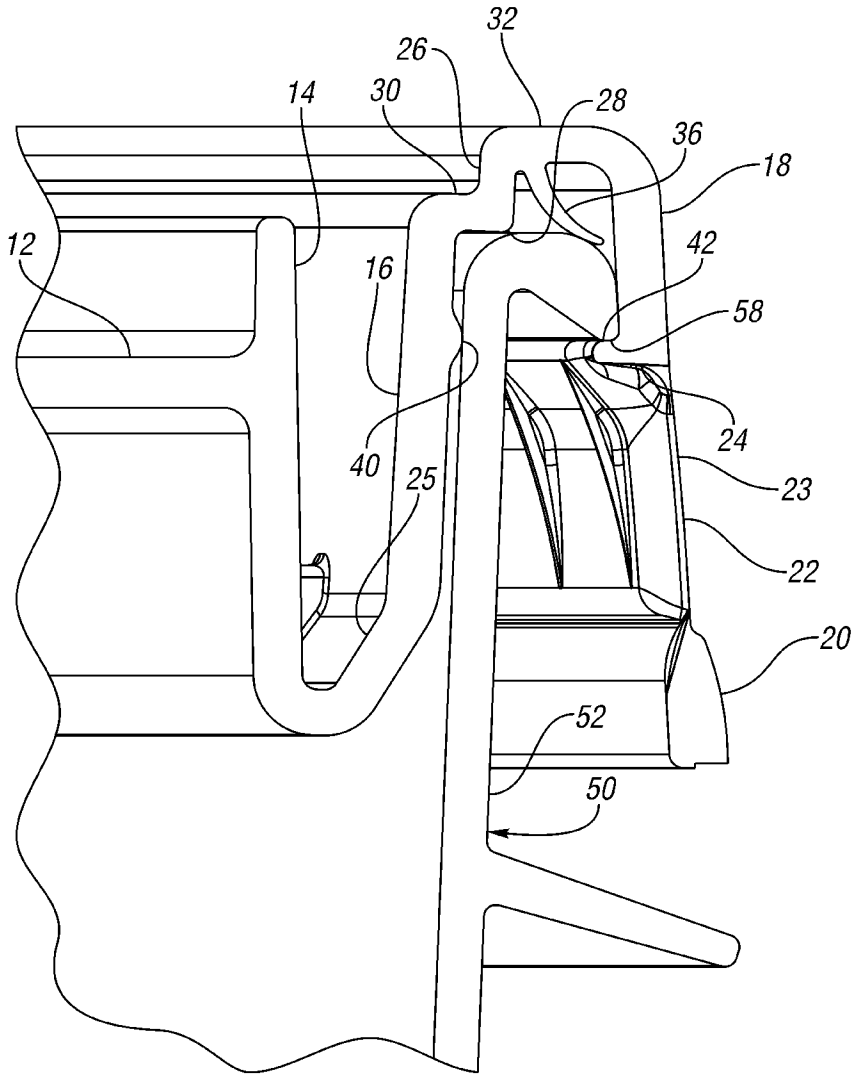
FIG. 5 is a section view similar to that of FIG. 4, but taken through the gap.

FIG. 5 is a section view similar to that of FIG. 4, but taken through the gap 23. As shown, the bridge portion 42 of the ledge 38 provides continuous contact between the lid 10 and the lip 58 of the pail 50 all around the circumference, including across the gaps 23. In prior art lids, the gaps each included a gap through the ledge as well, which provided a potential leak point between the lid and the pail. By providing a bridge portion 42 across the gap 23, there is continuous contact between the ledge 38 and the lip 58, thereby providing improved sealing.

Additionally, the optional stress riser 24 may make it easier to flex the tabs 22 outwardly (after removing the tear strip 20), by facilitating tearing and/or stretching of the bridge portion 42.

Figure 6:
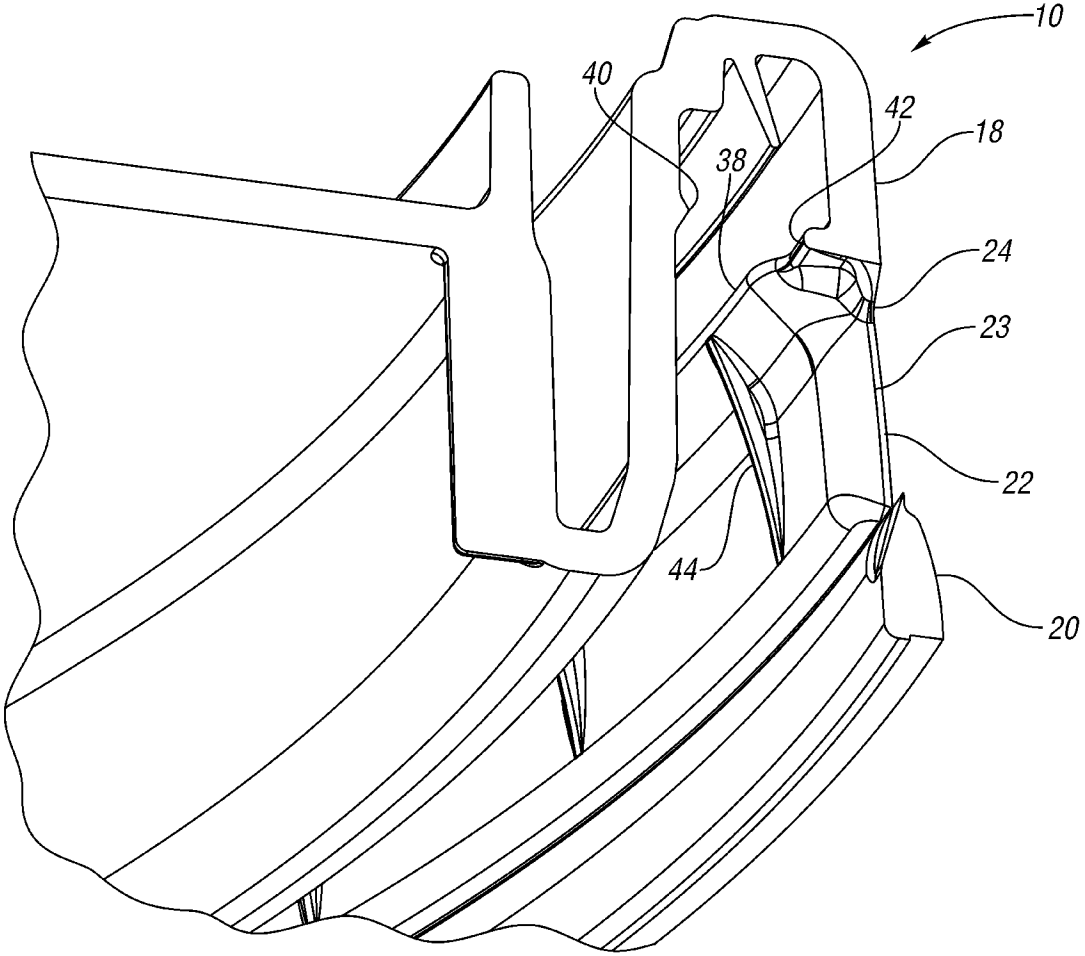
FIG. 6 is a bottom perspective view of the sectioned portion of the lid of FIG. 5, with the section taken again through the gap.

FIG. 6 is a bottom perspective view of the sectioned portion of the lid 10 of FIG. 5, with the section taken again through the gap 23. As can be seen more clearly in FIG. 6, the bridge portion 42 may protrude inwardly from the outer wall portion 18 less than the ledge 38. Ribs or gussets 44 may support the ledge 38 against the tabs 22 and reinforce the tabs 22 against the ledge 38 to provide more holding force on the pail.

Figure 7:
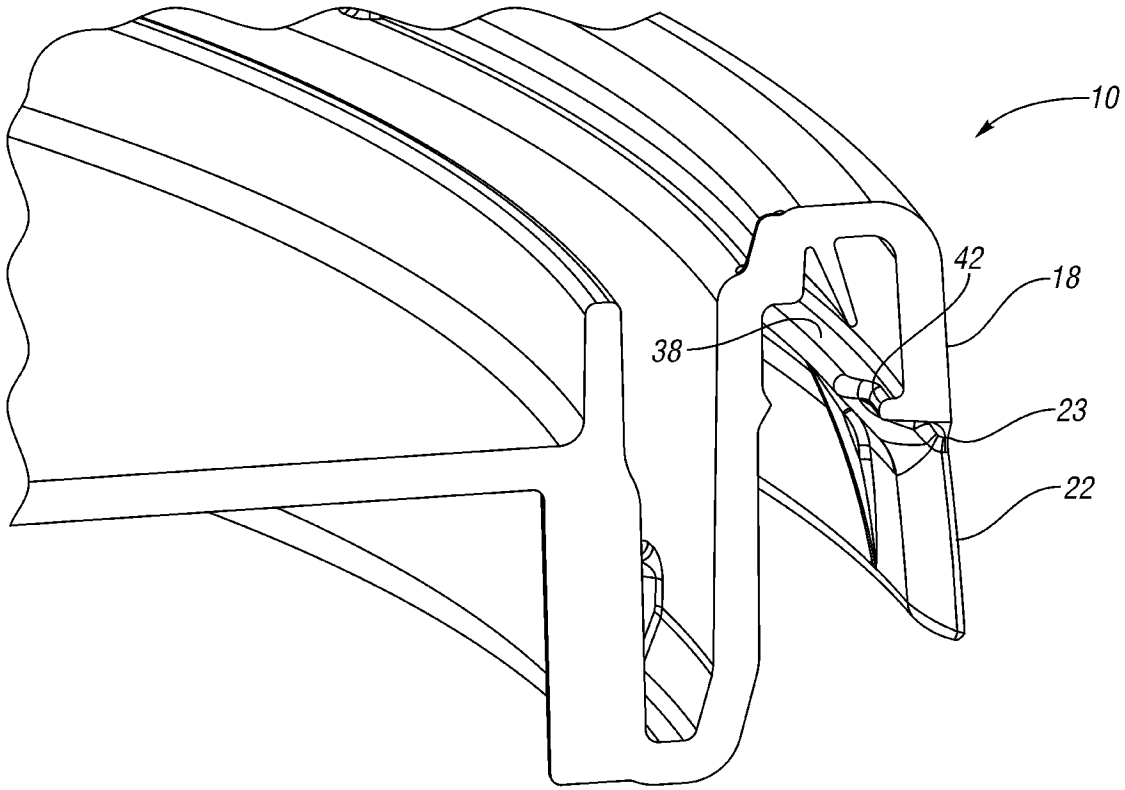
FIG. 7 is an upper perspective view of the sectioned portion of the lid of FIG. 6, but with the tear strip removed.
Figure 8:
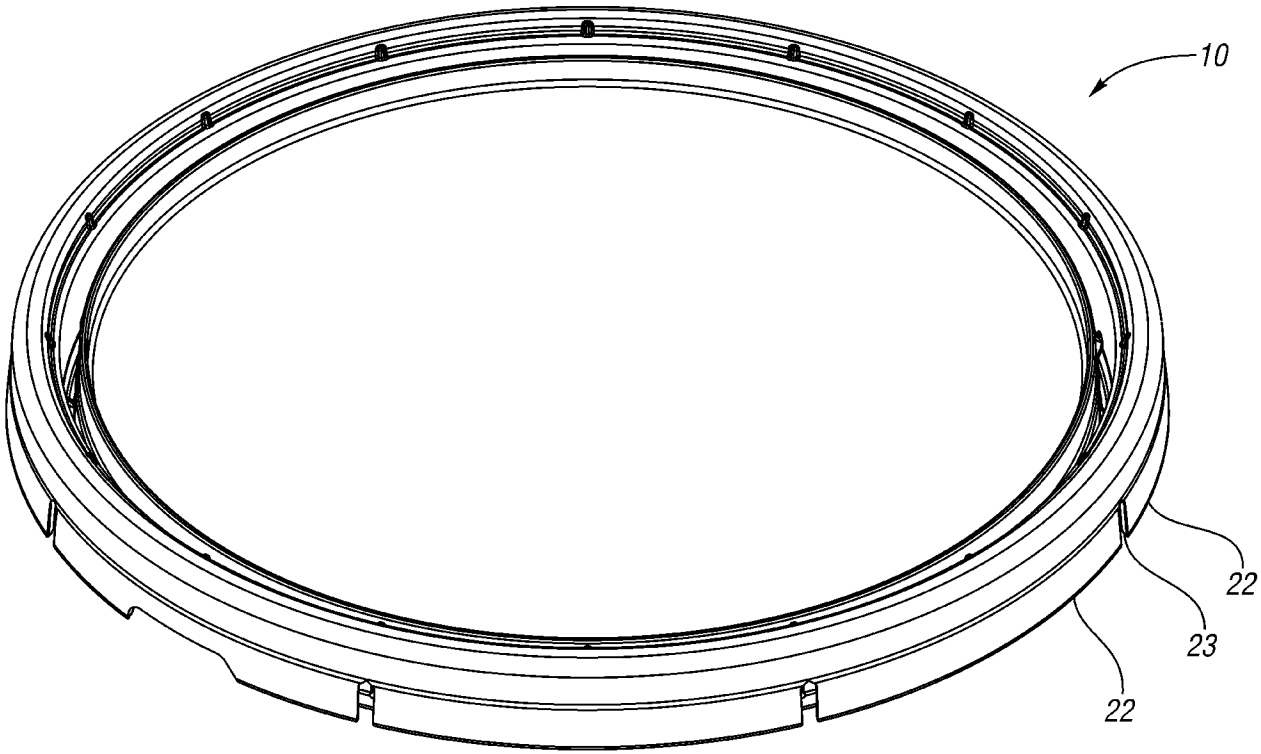
FIG. 8 is perspective view of the entire lid with the tear strip removed.

FIG. 7 is an upper perspective view of the sectioned portion of the lid 10 of FIG. 6, but with the tear strip 20 (FIG. 6) removed. After the tear strip 20 is removed, the tabs 22 can be flexed outwardly to move the ledge 38 and bridge portions 42 out from under the lip 58 of the pail 50 (FIG. 5). FIG. 8 is a perspective view of the entire lid 10 with the tear strip 20 (not shown) removed. The lid 10 and pail 50 are each separately injection molded of a suitable plastic.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. For one example, although the lid is shown as circular, the invention is also applicable to square or rectangular or any shape lid with a tear strip. The lid can be used on any type of container, not only pails.

What is claimed is:

1. A container lid comprising:

a panel portion;

an outer wall portion having a ledge protruding inwardly therefrom;

a plurality of tabs extending downward from the outer wall portion, two of the plurality of tabs separated from one another by a gap, the ledge of the outer wall portion extending across the gap, the ledge including a bridge portion extending across the gap, portions of the ledge other than the bridge protruding radially inwardly to a distance closer to a center of the lid than the bridge portion; and a tear strip removably connecting the plurality of tabs to one another.

2. The container lid of claim 1 wherein the bridge portion protrudes inwardly from the outer wall portion less than other portions of the ledge.

3. The container lid of claim 1 further including a stress riser in the outer wall portion above the gap.

4. The container lid of claim 3 wherein the stress riser is a narrowed portion at an upper portion of the gap.

5. The container lid of claim 1 wherein the gap is one of a plurality of gaps between the plurality of tabs, the ledge extending above each of the plurality of gaps.

6. The container lid of claim 1 installed on an upper portion of a wall of a container, the wall including an outwardly protruding lip, wherein the ledge provides continuous contact with the lip, including across the gap.

7. The container lid of claim 6 wherein the ledge includes a bridge portion extending across the gap.

8. The container lid of claim 7 wherein the bridge portion protrudes inwardly from the outer wall portion less than other portions of the ledge.

9. The container lid of claim 1 wherein the outer wall portion is annular.

10. The container lid of claim 1 further including:

an inner wall portion extending about a periphery of the panel portion; and a mid-wall portion between the inner wall portion and the outer wall portion.

11. The container lid of claim 10 installed on an upper portion of a wall of a container between the mid-wall portion and the outer wall portion, the wall including an outwardly protruding lip, wherein the ledge provides continuous contact with the lip, including across the gap.

12. A container and lid assembly comprising:

a container having a wall, a lip protruding outward from an upper edge of the wall; and a lid including a panel portion and an inner wall portion extending about a periphery of the panel portion, the lid including a mid-wall portion outward of the inner wall portion, the lid including an outer wall portion having a ledge protruding inwardly therefrom toward the mid-wall portion, the lid including a plurality of tabs extending downward from the outer wall portion, two of the plurality of tabs separated from one another by a gap, the ledge of the outer wall portion extending across the gap, the ledge including a bridge portion extending across the gap, wherein the bridge portion protrudes inwardly from an inner surface of the outer wall portion less than portions of the ledge other than the bridge, the ledge contacting the lip of the container including across the gap, the lid including a tear strip removably connecting the plurality of tabs to one another.

13. The container and lid assembly of claim 12 further including a stress riser in the outer wall portion above the gap.

14. The container and lid assembly of claim 13 wherein the stress riser is a narrowed portion at an upper portion of the gap.

15. The container and lid assembly of claim 13 wherein the stress riser is a narrowed portion of the gap at an upper portion of the gap.

16. The container lid of claim 15 wherein the stress riser includes a thinner wall above the narrowed portion of the gap.

17. The container lid of claim 3 wherein the stress riser is a narrowed portion of the gap at an upper portion of the gap.

18. The container lid of claim 17 wherein the stress riser includes a thinner wall above the narrowed portion of the gap.

19. A container and lid assembly comprising:

a container having a wall, a lip protruding outward from an upper edge of the wall; and a lid including a panel portion and an inner wall portion extending about a periphery of the panel portion, the lid including a mid-wall portion outward of the inner wall portion, the lid including an outer wall portion having a ledge protruding inwardly therefrom toward the mid-wall portion, the lid including a plurality of tabs extending downward from the outer wall portion, two of the plurality of tabs separated from one another by a gap, the ledge including a bridge portion extending across the gap, wherein portions of the ledge other than the bridge portion protrudes radially inward to a distance closer to a center of the lid than the bridge portion, a stress riser in the outer wall portion above the gap, the ledge contacting the lip of the container including across the gap, the lid including a tear strip removably connecting the plurality of tabs to one another.

20. The container and lid assembly of claim 19 wherein the stress riser is a narrowed portion of the gap at an upper portion of the gap.

21. The container and lid assembly of claim 20 wherein the stress riser includes a thinner wall above the narrowed portion of the gap.

* * * * *